US008392164B2

(12) United States Patent
Busby et al.

(10) Patent No.: US 8,392,164 B2
(45) Date of Patent: Mar. 5, 2013

(54) METHOD FOR EVALUATING AN UNDERGROUND RESERVOIR PRODUCTION SCHEME TAKING ACCOUNT OF UNCERTAINTIES

(75) Inventors: Daniel Busby, Rueil-Malmaison (FR); Mathieu Feraille, Houilles (FR); Thomas Romary, Paris (FR); Samir Touzani, Puteraux (FR)

(73) Assignee: IFP, Cedex (FR)

( * ) Notice: Subject to any disclaimer, the term of this patent is extended or adjusted under 35 U.S.C. 154(b) by 1071 days.

(21) Appl. No.: 12/185,161

(22) Filed: Aug. 4, 2008

(65) Prior Publication Data

US 2009/0043555 A1 Feb. 12, 2009

(30) Foreign Application Priority Data

Aug. 6, 2007 (FR) ..... 07 05740

(51) Int. Cl.
*G06G 7/57* (2006.01)

(52) U.S. Cl. ..... 703/10; 703/2

(58) Field of Classification Search ..... 703/10, 703/2

See application file for complete search history.

(56) References Cited

U.S. PATENT DOCUMENTS

| | | | | |
|---|---|---|---|---|
| 4,969,130 | A * | 11/1990 | Wason et al. | 367/73 |
| 5,992,519 | A * | 11/1999 | Ramakrishnan et al. | 166/250.15 |
| 7,054,752 | B2 * | 5/2006 | Zabalza-Mezghani et al. | 702/13 |
| 7,136,787 | B2 * | 11/2006 | Schlessinger et al. | 703/2 |
| 7,430,501 | B2 * | 9/2008 | Feraille et al. | 703/10 |
| 7,512,543 | B2 * | 3/2009 | Raghuraman et al. | 705/7.28 |
| 7,590,516 | B2 * | 9/2009 | Jourdan et al. | 703/10 |
| 7,672,825 | B2 * | 3/2010 | Brouwer et al. | 703/10 |
| 7,725,302 | B2 * | 5/2010 | Ayan et al. | 703/10 |
| 7,739,089 | B2 * | 6/2010 | Gurpinar et al. | 703/10 |
| 7,788,074 | B2 * | 8/2010 | Scheidt et al. | 703/10 |
| 7,809,538 | B2 * | 10/2010 | Thomas | 703/10 |
| 7,874,357 | B2 * | 1/2011 | Jalali et al. | 166/250.01 |

(Continued)

FOREIGN PATENT DOCUMENTS

| | | |
|---|---|---|
| EP | 1 484 704 A1 | 12/2004 |
| FR | 2 874 706 | 3/2006 |

OTHER PUBLICATIONS

Cullick, A. S. , et al: "Improved and More-Rapid History Matching with a Nonlinear Proxy and Global Optimization", SPE Annual Technical Conference and Exhibition, XX, XX, vol. 2, No. Paper 101933, Sep. 24, 2006, pp. 728-749, XP009086566.

*Primary Examiner* — Omar Fernandez Rivas
*Assistant Examiner* — Kibrom Gebresilassie
(74) *Attorney, Agent, or Firm* — Antonelli, Terry, Stout & Kraus, LLP.

(57) ABSTRACT

A method for evaluating an underground reservoir production scheme accounting for uncertainties is disclosed having applications, for example, to the development of petroleum reservoirs. Flow simulator input parameters characterizing the reservoir and the production scheme are selected. An approximate analytical model allowing the reservoir responses to be predicted is constructed. A desired degree of accuracy $D_p$ is defined, this degree of accuracy $D_p$ measuring the difference between the responses of the model and those of the simulator. The degree of accuracy $D_p(M)$ of the predictions of the model is calculated. Simulations are selected which are performed, pertinent for adjustment of the model. The simulations are carried out for each response simulated by the simulator and the analytical model is adjusted by means of an approximation method. This operation is repeated until the desired degree of accuracy $D_p$ is reached and the production scheme is evaluated by analyzing the reservoir responses predicted by the approximate analytical model.

16 Claims, 2 Drawing Sheets

U.S. PATENT DOCUMENTS

| | | | | |
|---|---|---|---|---|
| 7,877,246 | B2 * | 1/2011 | Moncorge et al. | 703/10 |
| 7,894,991 | B2 * | 2/2011 | Del Castillo et al. | 702/9 |
| 8,046,314 | B2 * | 10/2011 | Graf et al. | 706/15 |
| 2003/0220775 | A1 * | 11/2003 | Jourdan et al. | 703/2 |
| 2003/0225606 | A1 * | 12/2003 | Raghuraman et al. | 705/7 |
| 2004/0148147 | A1 | 7/2004 | Martin | |
| 2004/0254734 | A1 * | 12/2004 | Zabalza-Mezghani et al. | 702/13 |
| 2005/0004833 | A1 * | 1/2005 | McRae et al. | 705/11 |
| 2005/0096893 | A1 * | 5/2005 | Feraille et al. | 703/10 |
| 2005/0119911 | A1 * | 6/2005 | Ayan et al. | 705/1 |
| 2005/0149307 | A1 * | 7/2005 | Gurpinar et al. | 703/10 |
| 2005/0288910 | A1 * | 12/2005 | Schlessinger et al. | 703/2 |
| 2006/0047489 | A1 * | 3/2006 | Scheidt et al. | 703/10 |
| 2006/0095236 | A1 * | 5/2006 | Phillips | 703/2 |
| 2006/0241925 | A1 * | 10/2006 | Schaaf et al. | 703/10 |
| 2007/0156377 | A1 * | 7/2007 | Gurpinar et al. | 703/10 |
| 2007/0168170 | A1 * | 7/2007 | Thomas | 703/10 |
| 2007/0179767 | A1 | 8/2007 | Cullick et al. | |
| 2007/0192072 | A1 * | 8/2007 | Cullick et al. | 703/10 |
| 2008/0162100 | A1 * | 7/2008 | Landa | 703/10 |
| 2008/0288226 | A1 * | 11/2008 | Gurpinar et al. | 703/10 |
| 2009/0020284 | A1 * | 1/2009 | Graf et al. | 166/250.15 |
| 2009/0164186 | A1 * | 6/2009 | Haase et al. | 703/10 |

* cited by examiner

METHOD FOR EVALUATING AN UNDERGROUND RESERVOIR PRODUCTION SCHEME TAKING ACCOUNT OF UNCERTAINTIES

BACKGROUND OF THE INVENTION

1. Field of the Invention

The present invention relates to the sphere of petroleum reservoir exploration and development. More particularly, the invention relates to the evaluation of such reservoirs through the study and the optimization of production schemes for such petroleum reservoirs.

2. Description of the Prior Art

A production scheme is a reservoir development option. It combines all the parameters required for bringing a reservoir on stream. These parameters can be the position of a well, the completion level, the drilling technique, etc.

A reservoir survey comprises two main stages: a reservoir characterization stage and a production forecast stage.

The reservoir characterization stage constructs a reservoir model. A reservoir model is a model describing the spatial structure of the reservoir in a form of a space discretization which is materialized by a set of grid cells. Property values characterizing the reservoir: porosity, permeability, lithology, pressure, nature of the fluids, etc., are associated with each cell. Engineers only have access to a tiny part of the reservoir under study (measurements on cores, logs, well tests, etc.). They have to extrapolate these punctual data over the entire oil field to construct a reliable reservoir model. The notion of uncertainty therefore constantly has to be taken into account.

A "flow simulator" is used for production forecasting to enhance the production or, in general, to increase the commercial efficiency of the field, A flow simulator is software allowing, among other things, modelling of the production of a reservoir as a function of time from measurements describing the reservoir, that is from the reservoir model.

A flow simulator operates by accepting input parameters and by solving physical equations of fluid mechanics in porous media, in order to deliver information referred to as responses. All of the input parameters are contained in the reservoir model. The properties associated with the cells of this model are then referred to as parameters. These parameters are notably associated with the reservoir geology, the petrophysical properties, the reservoir development and the numerical options of the simulator. The responses (output data) supplied by the simulator are, for example, the oil, water or gas production of the reservoir and of each well for different times. Generally, for each value of the various input parameters, the flow simulator sends a single value for each response (output). The flow simulator is then referred to as deterministic.

However, the majority of the input parameters are uncertain. The effect of these uncertainties is that it is not possible to assign a single value having certainty to a parameter of the reservoir model. For example, the porosity at one point of the reservoir of 20% cannot be assured. It can be considered that the porosity ranges between 15% and 25% at this point. This is notably due to the fact that the input parameters are determined by means of a limited number of measurements and data. The possible responses of the flow simulator are therefore multiple, considering the uncertainty inherent in the reservoir model. In the above example, there will be a response from the simulator if the porosity is 15%, a different response if the porosity is 20.5%, etc. It is therefore essential to be able to quantify the uncertainty on the simulator output data. Similarly, correct characterization of the uncertainty of the input parameters is also essential. It is also important to determine the input parameters that have a significant effect on the responses of interest.

Oil reservoir development specialists therefore have to integrate these uncertainty notions into the evaluation of a reservoir to determine, for example, optimum production conditions.

In order to properly characterize the impact of each uncertainty on the oil production, many production scenarios have to be tested and a large number of reservoir simulations are therefore necessary.

However, in the petroleum industry, in order to be more and more reliable and predictive, the trend is to increasingly use complex flow simulators requiring a more and more detailed (several million grid cells) reservoir model. But, considering the considerable time required to carry out a flow simulation, it is unthinkable to test all the possible scenarios via a flow simulator.

In order to avoid carrying out a large number of simulations, a technique described in French Patent 2,874,706, based on designed experiments, is used. This method allows managing uncertainties via the construction of approximate models, referred to as "response surfaces", obtained by kriging for example. These surfaces provide responses that are approximate to those from the flow simulator.

However, any response surface makes a more or less significant prediction error, depending on the response to be approximated. In general, addition of information (that is simulations) allows constructing a more and more predictive response surface.

SUMMARY OF THE INVENTION

The invention is an alternative method for evaluating underground reservoir production schemes by estimating the production of such reservoirs by means of an approximate model, adjusted iteratively so as to best reproduce the simulator responses while controlling the number of simulations required for its construction.

The invention relates to a method for evaluating an underground reservoir production scheme. According to the method, physical properties characterizing the reservoir and the production scheme are selected. These properties are input parameters of a flow simulator allowing simulation of reservoir responses, such as the production. An approximate analytical model allowing the reservoir responses to be predicted is constructed. The method also comprises the following:

adjusting the approximate analytical model by means of an iterative process including:

a) defining, for each one of the responses, a desired degree of accuracy $D_p$, the degree of accuracy $D_p$ measuring a difference between responses predicted by the model and responses simulated by the simulator;

b) calculating a degree of accuracy $D_p(M)$ of predictions of the approximate analytical model;

c) if the value of $D_p(M)$ is below the desired degree of accuracy $D_p$, the iterative process stops and if the value of $D_p(M)$ is above the desired degree of accuracy $D_p$, the process continues:

d) constructing experiments for selecting simulations to be carried out, for adjusting the model, e) carrying out the selected simulations with a flow simulator, then, for each response simulated by the simulator, adjusting the analytical model by approximation to adjust responses predicted by the model to responses simulated by the simulator; and f) starting from b) again, until a desired degree of accuracy $D_p$ is reached, and evaluating the production scheme by analyzing the responses of the reservoir predicted by the approximate analytical model.

According to the invention, the desired degree of accuracy $D_p$ can be modified at each iteration. The input parameters can be uncertain, that is the values of these input parameters are uncertain.

The reservoir responses predicted by the approximate analytical model can be analyzed by quantifying an influence of each input parameter on each response, by means of a global sensitivity analysis, wherein sensitivity indices are calculated using the analytical model. This global sensitivity analysis allows determination of the parameters that are the most influential on the reservoir responses and to define measurements to be performed so as to reduce an uncertainty on the reservoir responses.

According to the invention, if the input parameters comprise at least one stochastic field, the stochastic field can be decomposed into a number n of components via a Karhunen-Loeve decomposition. The stochastic field components having an impact on the responses are then selected by means of the global sensitivity analysis.

BRIEF DESCRIPTION OF THE DRAWINGS

Other features and advantages of the method according to the invention will be clear from reading the description hereafter of embodiments given by way of non limitative example, with reference to the accompanying figures wherein.

DETAILED DESCRIPTION OF THE INVENTION

Figure 1:
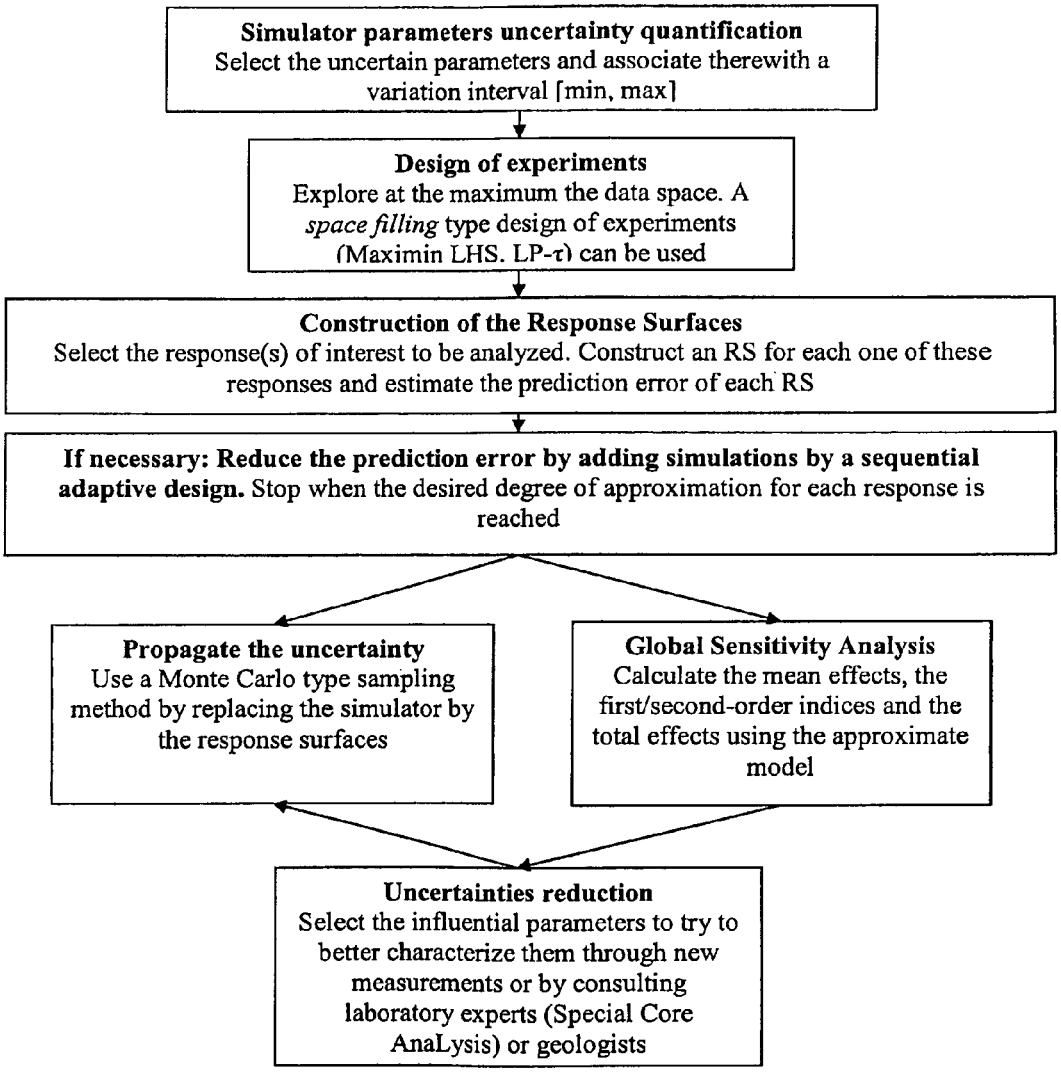
FIG. 1 shows a framework of the uncertainty management method according to the invention.

The method according to the invention allows optimizing the production scheme of a petroleum reservoir. The method is diagrammatically shown in FIG. 1. After selecting a flow simulator, the method comprises the following stages:

1—Selection and characterization of the uncertainties of the simulator input parameters 2—Construction of an approximate analytical model of the simulator 3—Adjustment of the approximate analytical model 4—Optimization of the reservoir production scheme.

Stage 1: Selection and Characterization of the Uncertainties of the Simulator Input Parameters Any flow simulator notably allows calculation of the production of hydrocarbons or of water as a function of time, from physical parameters characteristic of the petroleum reservoir, such as the number of layers of the reservoir, the permeability of the layers, the aquifer strength, the position of the oil wells, etc.

These physical parameters make up the input data of the flow simulator and are obtained through measurements performed in the laboratory on cores and fluids taken from the petroleum reservoir, by logging (measurements performed along a well), well tests, etc.

Among the physical parameters characteristic of the petroleum reservoir, input parameters having an influence on the hydrocarbon or water production profiles of the reservoir are preferably selected. These parameters can be selected either through physical knowledge of the petroleum reservoir, or by means of a sensitivity study. A statistical Student or Fischer test can for example be carried out.

Some parameters can be intrinsic to the petroleum reservoir. The following parameters can be considered for example: permeability of certain reservoir layers, aquifer strength, residual oil saturation after water sweep, etc.

Some parameters can correspond to reservoir development options. These parameters can be the position of a well, the completion level and the drilling technique.

After selection of the input parameters, the uncertainties associated with these parameters are characterized. A value of a parameter can for example be replaced by a variation range of this parameter.

Stage 2: Construction of an Approximate Analytical Model of the Simulator

Since the flow simulator is a complex and calculating time costly tool, it cannot be used to test all scenarios while accounting for all the uncertainties of the parameters. An approximate analytical model of the behaviour of the petroleum reservoir is then constructed. This approximate model is also referred to as "response surface". It sets analytical formulas with each formula expressing the behaviour of a given response of the flow simulator. These analytical formulas depend on a reduced number of parameters and are constructed from a limited number of simulations.

This approximate model expresses the behaviour of given responses, for example the 10-year cumulative oil production, according to some input parameters. Thus, for each response (output) of the flow simulator, necessary for production optimization or reservoir evaluation, an analytical formula allowing this response to be approximated from input parameters is associated.

Two techniques are combined to construct this approximate model of the flow simulator: an approximation method and a method of design of experiments.

Designs of experiments allow determination of the number and the location, in the space of the input parameters, of a limited number of simulations to be carried out to have a maximum amount of pertinent data, at the lowest cost possible.

The technique of designs of experiments is for example described in Droesbeke J. J, et al., 1997; "Plans d'Expériences, Applications à l'Entreprise", Editions Technip.

A design indicates different sets of values for the uncertain parameters. Each set of values of the uncertain parameters is used to carry out a flow simulation. In the space of the input parameters, each simulation represents a point. Each point corresponds to values for the uncertain parameters and therefore to a possible reservoir model. Selection of these points, by means of designs of experiments, can involve many types of criteria, such as orthogonality or space filling.

For this "exploratory" stage, selection of the simulation points can be achieved by means of different types of experiments, for example factorial designs, composite designs, maximum distance designs, etc. It is also possible to use a design of experiments of Maximin Latin Hypercube or Sobol LP-T type (A. Saltelli, K. Chan and M. Scott: "Sensitivity Analysis", New York, Wiley, 2000).

After constructing this design of experiments, and when the flow simulations have been performed, an approximation method is used to determine an approximate model. This model approximates the responses of the flow simulator. In a greatly simplified manner, four pairs (input parameter, response) are obtained by carrying out four simulations. A relation best respecting these pairs is then estimated.

In practice, since the parameters and the outputs are multiple, it is possible to use as the approximation method first or second order polynomials, neural networks, support vector machines or possibly polynomials of an order greater than two. Many other techniques are known, such as methods based on wavelets, SVMs, self-reproducing Hilbertian kernel, or nonparametric regression based on a Gaussian process or kriging (Kennedy M., O'Hagan A.: "Bayesian Calibration of Computer Models(with discussion)". J R. Statist. Soc. Ser. B Stat. Methodol. 68, 425-464, 2001). Selection of the method depends, on the one hand, on the maximum number of simulations that can be considered by the user and, on the other hand, on the initial design of experiments used.

Thus, to construct the approximate model, the following procedure is followed:

- constructing experiments to select a limited number of simulations;
- carrying out the simulations selected by the experiments by means of the flow simulator, from selected input parameters;
- for each response of the simulator, defining an analytical formula relating the selected input parameters to the response (obtained from the simulations), by means of an approximation method.

Stage 3: Adjustment of the Approximate Analytical Model

Figure 2:
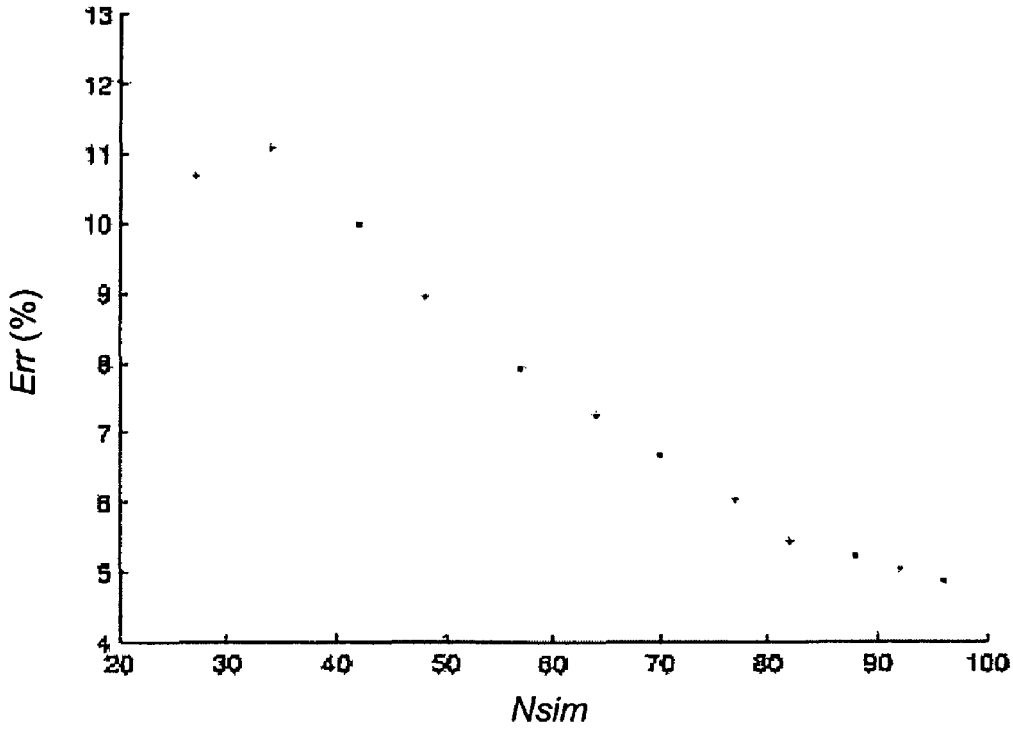
FIG. 2 shows an example of evolution of the estimated prediction error (in %) of a response surface (approximate model).

The obtained approximate model allows prediction of the outputs of the flow simulator with a certain accuracy. According to the invention, the method comprises measuring the prediction accuracy of this model so as to define an evaluation criterion associated with the accuracy of the constructed approximate model. FIG. 2 illustrates an example of evolution of the estimated prediction error (Err) of a response surface (approximate model), as a function of the number of simulations (Nsim) used for constructing the response surface. In this example, the response surface approximates the flow simulator output corresponding to the reservoir oil flow rate after 10-year production.

This criterion allows a user to decide on the possible addition of simulations in order to improve the prediction reliability of the model.

The required prediction degree is obtained iteratively. This stage is divided up as follows:

a) defining a degree of accuracy $D_p$ of the prediction of the approximate model that is sought for each response of the simulator to be analyzed;

b) estimating the degree of accuracy $D_p(M)$ of the approximate analytical model. This estimation can be performed using cross-validation or bootstrap type methods, c) if the value $D_p(M)$ is below the desired degree of accuracy $D_p$, the automatic iterative process stops and if the value of $D_p(M)$ is above the desired degree of accuracy $D_p$, the process continues with the following stages:

d) selecting p new input parameter combinations in the space of the input parameters, by means of an adaptive method. An adaptive method adds information in places where it is missing, and where the approximate model is not predictive enough. Such methods are well known to, e) carrying out the corresponding p simulations and modifying the approximate model accordingly, f) starting from stage b) again, until the desired degree of accuracy is reached. It is also possible to start from stage a) again, so as to define a new degree of accuracy. The process can also be stopped "manually".

The number p of simulations carried out at each iteration can be controlled by the user according to the number of machines, for example, available for simulations.

The approximate model that is obtained allow prediction of the responses quasi-instantaneously (in calculating time) and it thus eliminates calculation of the time costly flow simulator. A large number of production scenarios can therefore be tested while taking account of the uncertainty of each input parameter.

The methods used for selecting new points in the parameters space in stage d) can be diverse. One of the methods described in the following documents can for example be used as a basis:

Scheidt C., Zabalza-Mezghani I., Feraille M., Collombier D.: "Adaptive Evolutive Experimental Designs for Uncertainty Assessment—An Innovative Exploitation of Geostatistical Techniques", IAMG, Toronto, 21-26 August, Canada, 2005.

Busby D., Farmer C. L., Iske A.: "Hierarchical Nonlinear Approximation for Experimental Design and Statistical Data Fitting". SIAM J. Sci. Comput. 29, 1, 49-69, 2007.

In Busby et al., a partition of the space into different zones of equivalent size (a method known as adaptive gridding) is first carried out. The new points are then added in the zones where the prediction of the approximate model is not good (that is below the degree of accuracy $D_p$ set by the user). The prediction of the model is calculated independently in each zone. This prediction error is calculated by taking the mean of the errors obtained by cross-validation (leave-one-out).

The addition of simulations in stage e) is automatically repeated until a stop criterion linked with the degree of prediction wanted by the user, defined in stage a), for example 5% mean error prediction of the response studied, is met. An example of estimation of the prediction is obtained from the mean of the cross-validation errors in each zone.

The responses of interest which are selected can correspond to direct outputs of the flow simulator or to output combinations and interpolations. For example, one can be interested in:

- only the cumulative oil (gas, water) production of the reservoir at the final production time;
- the cumulative oil (gas, water) production of the reservoir for various times;
- the addition of the oil production and the water production;
- the oil production for fixed water cut (or water production) values; and
- the duration of the production profile plateau.

Furthermore, economic uncertainties can be readily added and combined with the technical uncertainties so as to define responses associated with the economic value of the reservoir such as, for example, the net present value (NPV), instead being limited to technical responses (oil, gas, water production). Such a method is described in EP patent application 1,484,704.

4: Production Scheme Optimization and Reservoir Evaluation

The principle of production scheme optimization defines various production scenarios and, for each one, in predicting the production. This technique also allows a communication evaluation of a petroleum reservoir.

During this production forecast stage, the approximate model is used because it is simple and analytical, and therefore each estimation obtained by this model is immediate, which represents a considerable saving in time. Using this model allows reservoir engineers to test as many scenarios as desired, without worrying about the time required to carry out a numerical flow simulation, and above all it allows the reservoir engineers to take account of the uncertainties by testing different input parameter values.

The approximate analytical model is used with direct sampling techniques of the Monte Carlo or Quasi-Monte Carlo type (MCMC, Latin Hypercube, etc.) in order to propagate the input parameter uncertainties to the simulator response(s) which are selected.

The probability distributions associated with the simulator outputs are thus obtained. These distributions are useful in making decisions on the development of the reservoir in question, considering the possible production or economic value and the associated uncertainty.

According to a particular embodiment, the approximate model is used to carry out a global sensitivity analysis so as to select the parameters that influence the reservoir production, in order to perform the measurements required for better reservoir evaluation.

It is for example interesting to know that the activity of the aquifer or the permeability of a particular geological layer plays a dominating part in the future production results of the reservoir.

The GSA (Global Sensitivity Analysis) of the uncertain parameters relative to the simulator responses allows analysis in detail of the impact of the uncertainty of each uncertain parameter or group of parameters on the uncertainty of the simulator responses. Such a technique is described in:

Saltelli, K. Chan and M. Scott: "Sensitivity Analysis", New York, Wiley, 2000

Oakley and A. O'Hagan: "Probabilistic Sensitivity Analysis of Complex Models: A Bayesian Approach", J. Roy. Statist. Soc. Ser. B, 16, pp. 751-769, 2004.

GSA is based on a Sobol's decomposition. This decomposition is described in the following document: I.M Sobol: "Sensitivity Estimates for Nonlinear Mathematical Models". Mathematical Modelling and Computational Experiments, 1:407-414,1993.

To describe the method, a mathematical model is considered which is described by a function f(x), $x=(x_1, \ldots, x_p)$ and defined in a p-dimensional space $\Omega^p=\{x|0\leqq x_i\leqq 1; i=1, \ldots p\}$.

The main aspect of Sobol's decomposition is to decompose $f(x_1, \ldots, x_p)$ as follows:

$$f(x_1, \ldots, x_p) = f_0 + \sum_{i=1}^{p} f_i(x_i) + \sum_{1\leq i<j\leq p} f_{ij}(x_i, x_j) + \ldots + f_{1,2\ldots,p}(x_1, \ldots, x_p)$$

with $f_0$ a constant and $$\int_0^1 f_{i1,\ldots,is}(x_{i1}, \ldots, x_{is})dx_{ik} = 0,$$

where $1\leqq i1<\ldots<is\leqq p$, $s=1, \ldots, p$ and $1\leqq k\leqq s$.

According to this definition, it can be written:

$$f_0 = \int_{\Omega^p} f(x)dx$$

and if $(i1, \ldots, is)\neq(j1, \ldots, j1)$, then $$\int_{\Omega^p} f_{i1,\ldots,is} f_{j1,\ldots,jl} dx = 0.$$

Sobol showed that the decomposition of $f(x_1, \ldots, x_p)$ is unique and that all the terms can be evaluated via multidimensional integrals:

$$f_i(x_i) = -f_0 + \int_{\Omega^{p-1}} f(x)dx^i$$

$$f_{i,j}(x_i, x_j) = -f_0 - f_i(x_i) - f_j(x_j) + \int_{\Omega^{p-2}} f(x)dx^{ij}$$

with $dx^i$ and $dx^{ij}$ the product $dx_1 \ldots dx_p$ without $dx_i$, and $dx_i$ $dx_j$, respectively.

The total variance V of f(x) can then be written:

$$V = \sum_{i=1}^{k} V_i + \sum_{1\leq i<j\leq p} V_{ij} + \ldots + V_{1,2,\ldots,p}$$

$$\text{or: } V = \int_{\Omega^p} f^2(x)dx - f_0^2.$$

Then, in order to explain the part of the variance of the responses due to the input parameters, the following sensitivity index can be defined:

$$s_{i1,\ldots,is} = \frac{V_{i1,\ldots,is}}{V} \text{ for } 1 \leq i1 < \ldots < is \leq p.$$

$S_i$ is referred to as first-order sensitivity index for factor $x_i$. This index measures the part of the variance of the response explained by the effect of $x_i$.

$S_{i,j}$, for $i\neq j$, is referred to as second-order sensitivity index. This index measures the part of the variance of the response due to the interactions between the effects of $x_i$ and $x_j$.

The total sensitivity index, $S_{Ti}$ for a particular parameter $x_i$, defined as the sum of all the sensitivity indices involving the parameters, can also be very useful for measuring the part of the variance of the response explained by all the effects wherein $x_i$ plays a part.

$$S_{Ti} = \sum_{k\#i} S_k$$

where #i represents all the terms $S_{i1,\ldots,is}$ that involve index i.

The global sensitivity analysis allows explanation of the variability of the responses as a function of the input parameters, through the definition of total or partial sensitivity indices. These indices can be estimated by means of Monte Carlo or Quasi-Monte Carlo techniques allowing approximation of the various multidimensional integrals, requiring broad sampling.

Thus, the global sensitivity analysis cannot be used directly using a flow simulator. According to the invention, the sensitivity indices are calculated using analytical models for each response. These analytical models are constructed as described above.

The Global Sensitivity Analysis (GSA) used with the invention does not have the conventional limitations linked with the hypotheses that can be found in other methods allowing sensitivity index calculations, such as Spearman, Pearson, SRC, sensitivity ranking, etc., type methods. The only hypothesis is that the uncertain parameters are independent, which greatly widens the use of the GSA using Sobol's decomposition. This hypothesis is generally respected in reservoir engineering problems since the links between parameters are known a priori.

During this analysis, the contribution of the uncertainty of each parameter to the total variance of the response(s) is determined. The principle calculates several sensitivity indices (first, second, . . . n-th order and total indices) allowing knowledge of the precise influence of each parameter or group of parameters on the responses of interest. These indices are calculated by means of formulas requiring calculation of multiple integrals, which can be approximately carried out by means of Monte Carlo or Quasi-Monte Carlo techniques.

Global Sensitivity Analysis (GSA) of the uncertain parameters on the simulator responses also allows evaluation of the mean effect of a parameter on a given response. This mean effect can be used for example for controllable parameters, for example, of the position of a well, rate of inflow, etc., and it therefore constitutes a simple parameter behaviour tool.

Using the approximate model for carrying out the GSA allows determination of the influential parameters and the way they are influential. It is thus possible to know the total impact of a parameter, as well as its impact combined with one or more other parameters on the reservoir production or economic response. GSA clearly allows better understanding of the reservoir behavior. Furthermore, determination of the mean effects of the parameters is also a tool allowing characterization of the mean influence of a parameter, considering the uncertainty on the other parameters on the reservoir production or economic responses.

Finally, the additional measurements to be performed in order to better characterize the reservoir and thus to reduce the uncertainty on the future production can be determined. Quantification of the influence of the uncertain parameters on the reservoir production allows the most influential parameters to be determined. Thus, in order to limit the uncertainty on the future production or economy of the reservoir, the most influential parameters are characterized first. Using the methodology described thus enables the reservoir engineer to determine the parameters that need to be better defined and it therefore gives a guide for selecting the new measurements to be performed (logging, coring, SCAL, etc.). Once the influential parameters are better characterized by measurements, it is then possible to use again the methodology described in order to propagate the uncertainty for quantifying the new uncertainty on the reservoir production or economic responses.

Propagation, global sensitivity analysis and mean effect calculation require several thousand evaluations of the associated response(s). This makes these methods unusable directly with large numerical codes (as it is the case for flow simulators), hence the advantage of constructing predictive approximate models allowing use of these techniques that are very interesting for the responses they provide to professional questions.

According to another embodiment, the input parameters comprise stochastic fields, for example permeability, porosity, facies, etc. The uncertainty coming from geostatistical maps is often disregarded in uncertainty analysis methods based on designs of experiments.

In the case of stochastic field type parameters, the stochastic field is decomposed into a number n of components via the Karhunen-Loeve decomposition (M. M. Loève. Probability Theory. Princeton University Press, 1955.). Most geostatistical techniques used in reservoir engineering for modelling rock permeability and porosity quantities are based on Gaussian random functions, discretized on a grid covering the physical space of the reservoir. The Karhunen-Loeve decomposition of a geostatistical model represents it in the base made up of the eigenvectors of its covariance operator. A functional representation of the random field is thus obtained. Keeping only a limited number of components in this representation allows obtaining an approximation of the random field that represents a quantifiable part of the variance of the process. In fact, each term of the decomposition is assigned a part of the global variance that is equal to the eigenvalue associated with the corresponding eigenvector. It is thus possible to quantify the approximation error in terms of variance. The number of components required to reproduce the geostatistical model is often quite large. Numerical tests show that a hundred components can be necessary in some cases. However, in many cases, only the variation of a limited number of these components will impact the simulated production responses of the reservoir model, for example the 10-year cumulative oil production. According to the invention, the components of the stochastic field having an impact on the simulated responses of interest are selected by means of a global sensitivity analysis with an approximate model as described in the previous stages.

Advantages

The method according to the invention constitutes a tool for analyzing the uncertainties of a flow simulator and for helping engineers to reduce this uncertainty by focusing on the characterization of the parameters whose uncertainty chiefly contributes to the bad characterization of the outputs.

This method provides a robust and inexpensive (in terms of number of simulations) tool for global sensitivity analysis and uncertainty propagation. It allows engineers to control the degree of approximation of their results by analyzing in real time the advantages in terms of prediction in relation to the number of simulations performed.

The global sensitivity analysis and the mean effect of the parameters allow seeing the impact of the uncertainty of a parameter on the global uncertainty of a response, and therefore provides a guide for the selection of the new measurements to be performed in order to better characterize the parameters playing a central part in the production or economic results.

Finally, the method allows accounting for the uncertainties of the geostatistical model (permeability, porosity, facies, etc.) through the use of response surface and global sensitivity analysis techniques.

The invention claimed is:

1. A method for evaluating underground reservoir production, wherein physical properties characterizing the reservoir and the production are selected, the properties being input parameters of a flow simulator implemented in a computer allowing simulation of reservoir responses and constructing an analytical model implemented in a computer allowing the reservoir responses to be predicted comprising:

adjusting the analytical model with an iterative process including:

a) defining, for each of the responses, a desired degree of accuracy, the degree of accuracy measuring a difference between the reservoir responses predicted by the analytical model and the reservoir responses simulated by the simulator;

b) calculating a degree of accuracy of reservoir predictions of the approximate analytical model;

c) continuing the iterative process when the calculated degree of accuracy is above the desired degree of accuracy to:

d) construct a design of experiments to select simulations of the reservoir responses to be carried out for adjusting the analytical model;

e) carry out the simulations selected by the experiments with the flow simulator implemented in a computer, and, for each response simulated by the simulator, adjust the analytical model using an approximation to adjust the reservoir responses predicted by the analytical model to the reservoir responses simulated by the simulator;

f) repeat steps c)-e) until the desired degree of accuracy is reached;

g) evaluate the production by analyzing the reservoir responses predicted by the analytical model; and h) stop the iterative process without performing steps d)-g) if the degree of accuracy is below the desired degree of accuracy, and wherein the reservoir responses predicted by the analytical model are analyzed by quantifying an influence of each input parameter on each response, with a global sensitivity analysis, and sensitivity indices are calculated using the analytical model and the input parameters comprise at least one stochastic field, the stochastic field is decomposed into components via a Karhunen-Loeve decomposition and the stochastic field components having an impact on the responses are selected using the global sensitivity analysis.

2. The method as claimed in claim 1, wherein the desired degree of accuracy is modified at each iteration.

3. The method as claimed in claim 1, wherein values of the input parameters are uncertain.

4. The method as claimed in claim 2, wherein values of the input parameters are uncertain.

5. The method as claimed in claim 1, wherein parameters influencing the responses of the reservoir are selected by using the global sensitivity analysis and defining measurements to be performed to reduce an uncertainty of responses of the reservoir.

6. The method as claimed in claim 2, wherein parameters influencing the responses of the reservoir are selected by using the global sensitivity analysis and defining measurements to be performed to reduce an uncertainty of responses of the reservoir.

7. The method as claimed in claim 3, wherein parameters influencing the responses of the reservoir are selected by using the global sensitivity analysis and defining measurements to be performed to reduce an uncertainty of responses of the reservoir.

8. The method as claimed in claim 4, wherein parameters influencing the responses of the reservoir are selected by using a global sensitivity analysis and defining measurements to be performed to reduce an uncertainty of responses of the reservoir.

9. The method as claimed in claim 1, wherein the simulated reservoir response is the reservoir production.

10. The method as claimed in claim 2, wherein the simulated reservoir response is the reservoir production.

11. The method as claimed in claim 3, wherein the simulated reservoir response is the reservoir production.

12. The method as claimed in claim 4, wherein the simulated reservoir response is the reservoir production.

13. The method as claimed in claim 5, wherein the simulated reservoir response is the reservoir production.

14. The method as claimed in claim 6, wherein the simulated reservoir response is the reservoir production.

15. The method as claimed in claim 7, wherein the simulated reservoir response is reservoir production.

16. The method as claimed in claim 8, wherein the simulated reservoir response is the reservoir production.

* * * * *